United States Patent [19]

Nebell

[11] 4,176,037

[45] Nov. 27, 1979

[54] CONDUCTOR ARRANGEMENT FOR COMPENSATING FOR HORIZONTAL MAGNETIC FIELDS IN POTS CONTAINING A MOLTEN ELECTROLYTIC BATH

[75] Inventor: Hans G. T. Nebell, Snaroya, Norway

[73] Assignee: Årdal og Sunndal Verk a.s., Norway

[21] Appl. No.: 917,019

[22] Filed: Jun. 16, 1978

[30] Foreign Application Priority Data

Jul. 14, 1977 [NO] Norway ..... 772507

[51] Int. Cl.[2] ..... C25C 3/16

[52] U.S. Cl. ..... 204/243 M; 204/244

[58] Field of Search ..... 204/243 M, 244, 243 R, 204/245–247, 67

[56] References Cited

U.S. PATENT DOCUMENTS

| | | | |
|---|---|---|---|
| 3,063,919 | 11/1962 | Jouguet et al. | 204/243 M X |
| 4,049,528 | 9/1977 | Morel et al. | 204/67 X |
| 4,090,930 | 5/1978 | Morel et al. | 204/243 M X |
| 4,132,621 | 1/1979 | Morel et al. | 204/243 M |

*Primary Examiner*—John H. Mack
*Assistant Examiner*—D. R. Valentine
*Attorney, Agent, or Firm*—Wenderoth, Lind & Ponack

[57] ABSTRACT

An arrangement is provided for compensating for detrimental magnetic horizontal fields at the plus or upstream end of longitudinally oriented pots in plants for melt-electrolytic production of aluminium, in particular where compensation for vertical magnetic influence from one pot row to another is provided for by utilizing an anode current supply to the minus or downstream end of each pot. A smaller proportion of the current supply to the minus end of the pot takes place through one or more conductors being located underneath the pot in the longitudinal direction thereof, said smaller proportion of the current supply being preferably no more than 20% of the total anode current supply.

4 Claims, 3 Drawing Figures

CONDUCTOR ARRANGEMENT FOR COMPENSATING FOR HORIZONTAL MAGNETIC FIELDS IN POTS CONTAINING A MOLTEN ELECTROLYTIC BATH

BACKGROUND OF THE INVENTION

This invention relates to an arrangement for compensating for detrimental magnetic horizontal fields at the plus or upstream end of pots arranged longitudinally in plants for producing aluminium by electrolytic reduction in a molten bath.

In Norwegian Pat. No. 122,680 there is described an arrangement for compensating for the detrimental magnetic influence on a row of pots from another pot row in plants for producing metal, for instance aluminium, by electrolytic reduction. The form of compensation with which the present invention is concerned, is of particular interest in such plants where there is provided for compensation of the detrimental influence between pot rows in the electrolyzing plant. However, the present invention is not limited to use in such plants, but can also be utilized in plants in which there is no significant mutual magnetic influence between the pot rows, for example in pot rooms with a large space between the pot rows.

In pots for the electrolysis of a molten bath the electrolysis current will flow substantially in a vertical direction between the anode and the cathode. In association with the current flowing in riser conductors, the anode conductor and bus bars there is generated a horizontal magnetic field. This field sets up movements in the electrolyte or molten bath and in the metal, and causes a curvature of the metal surface. These movements and this curvature are detrimental and according to experience result in an instable pot operation and reduced current yield.

Various precautions have previously been known for reducing or eliminating the detrimental effects of undesired magnetic fields in electrolytic cells or pots, these also including horizontal magnetic fields of the kind which are to be compensated for by the present invention. One example may be found in British Pat. No. 794,421, which, however, attempts to limit the detrimental effects by modifying the distribution of the electrolysis current in the metal sump. In the present invention, however, the attention is primarily directed to the undesired magnetic field components, in particular for the purpose of obtaining full symmetry and a better field distribution of the horizontal field component laterally of the pot. This method also influences the movements in the electrolytic bath, and these have as much significance as the movements in the metal sump.

It is emphasized that the present invention is exclusively directed to plants having the pots arranged longitudinally in the pot rows, which within the smelting industry is regarded as an arrangement being fundamentally different from an arrangement with laterally oriented pots. Norwegian Pat. No. 124,318 is directed to an arrangement of laterally oriented electrolytic cells, and to the provision of bus bars underneath these lateral pots. This known arrangement in connection with lateral pots has not, however, been of any assistance to experts occupied with the problems of irregularities in magnetic horizontal fields in longitudinally oriented pots for producing metal, for example aluminium, by electrolytic melting. The current and field relationships in electrolytic cells or pots are so complicated that in practice it is about impossible to transfer experience or solutions with respect to magnetic field compensation from laterally oriented pots to longitudinally oriented pots or vice versa. This also applies to a high degree to the problems of detrimental magnetic horizontal fields.

In plants with longitudinally oriented pots the current is usually conducted to each pot with a main proportion to one end thereof, designated the plus or upstream end, whereas a smaller proportion is conducted to the other end, namely the minus or downstream end. According to Norwegian Pat. No. 122,680 all current to the minus end of the pot is conducted along that side which faces the adjacent pot row. In order to obtain a bus bar system which is as economical as possible, the compensation conductor is arranged as close to the pot as possible, so that there is needed no more than one example approximately 30 kA for obtaining a full compensation of a pot for 150 kA. Such a current distribution gives a favourable vertical field, but the horizontal field will be too strong and will have an unfavourable distribution at the plus end of the pot.

SUMMARY OF THE INVENTION

Thus, this invention more particularly relates to an arrangement for compensating for detrimental magnetic horizontal fields at the plus end of longitudinal pots in plants for the melt-electrolytic production of aluminium, especially in which compensation for vertical magnetic influence from one pot row to another is provided for by utilizing an anode current supply to the minus end of each pot. What is novel and specific to the arrangement according to this invention in the first place consists therein that a smaller proportion of the current supply to the minus end of the pot takes place through one or more conductors positioned underneath the pot in the longitudinal direction thereof. This or these particular conductors which run underneath the pot, provide a magnetic field which reduces the detrimental horizontal field at the plus end of the pot and which increases the horizontal field at the minus end thereof. With a suitable dimension of that proportion of the current supply which is led underneath the pot, such that there is here conducted a correct current value, it will be possible to obtain full symmetry of the horizontal field components laterally of the pot so that this field is approximately zero at the centre of the pot. In addition thereto it is an important advantage that the form of the horizontal magnetic field laterally of the pot will be more favourable since the field strength will then have smaller variations across the pot. This reduces undesired flow patterns both in the electrolytic bath and in the molten metal.

It is of essential importance to the practical usefulness of the arrangement stated here, that the above smaller proportion of the current supply which is conducted underneath the pot in the longitudinal direction thereof, can be a rather small fraction of the total anode current supply when considering pots located inwardly from the ends of the pot row. Thus, according to a particular embodiment of the invention a maximum of 10% of the total anode current supply to such inwardly located pots in the pot row, constitutes the above smaller proportion of the current supply underneath the pots. This does not mean that the pots at the ends of the pot rows cannot take advantage of an arrangement according to this invention. On the contrary, the arrangement according to the invention has a particularly good effect in the pots at the ends of the pot rows, in which the particularly difficult relationships with respect to the magnetic field picture makes it very advantageous to employ the arrangement stated here, i.e. with current porportions underneath the pot which most often will be significantly higher than the above maximum of 10% of the total anode current supply, such as up to 20% of the total current.

Finally, according to the invention it is particularly advantageous for the current conduction underneath the pot, to employ a conductor or conductors in the form of flat bars mounted closely adjacent the pot bottom with one flat side facing the same. Thereby there is obtained the shortest possible distance between the current path for the compensation current and that region of the pot which shall be influenced by the magnetic field.

BRIEF DESCRIPTION OF THE DRAWINGS

The invention shall be explained in more detail below with reference to the drawings in which FIG. 1 schematically shows an example of pot rows having an arrangement according to the invention, whereas

DETAILED DESCRIPTION OF THE INVENTION

Figure 1:
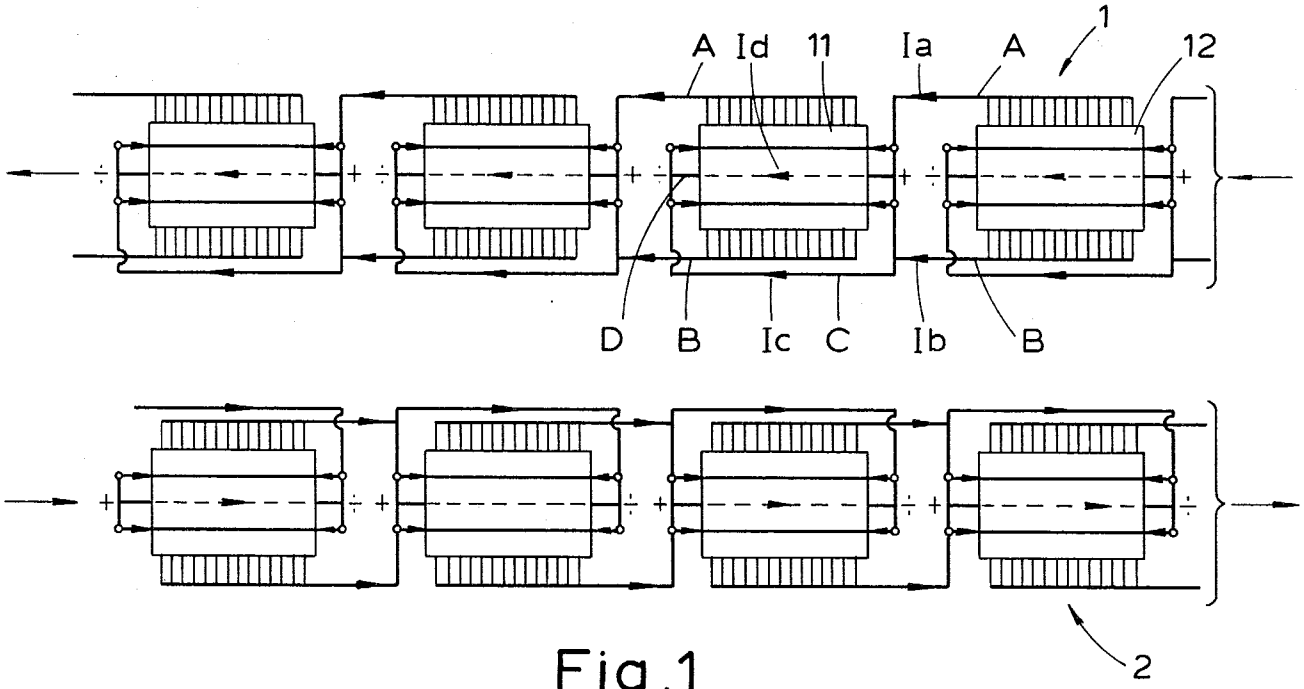

In FIG. 1 of the drawings there is shown a pot arrangement with two pot rows 1 and 2 of which one pot row 2 is supplied with a current flowing from left to right in the figure, whereas the current in the other pot row flows from right to left. With plus signs and minus signs there is indicated for each of the pots in pot row 1 which is the plus or positive end and which is the minus or negative end of the respective pots.

When considering in FIG. 1 pot 11 in pot row 1 and the current supply thereto from the preceding pot in the row, i.e. from pot 12, it appears that the current from pot 12 to pot 11 is represented by $I_a$ and $I_b$ which are collected separately in a cathode bus bars A and B, respectively. The main proportion of this current, i.e. approximately 65–75%, is led directly to anode bus bars at the plus end of pot 11, whereas the remaining part of the current is led to the minus end of this pot through respective current conductors C and D. The current $I_c$ flowing in conductor C along one side of pot 11 provides vertical compensation, such as for example as stated in Norwegian Pat. No. 122,680, whereas the current $I_d$ in conductor D is led underneath pot 11 for adjusting the horizontal magnetic field of the pot according to the present invention. FIG. 1 shows the arrangement rather schematically and it is obvious that the conductor D may be split into two or more conductors if this is practical.

The practical design and the necessary current value for vertical and horizontal magnetic field compensation depend upon many factors, such as the spacing between the pot rows, the distance between the individual pots in each row and the location of the cathode bus bars and other outer conductors. The illustrated particular conductor or bus bar D underneath the pot is very effective, however, and with a total current of 150 kA to the pot in which usually will necessitate a current value of up to about 30 kA for vertical compensation, it is sufficient for about 10 kA to be led underneath the pot for horizontal compensation. Of the total current in this example there is thus about 40 kA supplied to the minus end of the pot and 110 kA to the plus end thereof.

With simultaneous vertical and horizontal compensation as described above, an increased proportion of the current supply along the side of the pot for vertical compensation, as a rule will make it possible to reduce the horizontal compensation current underneath the pot. These two forms of compensation thus depend on each other and the practical adjustment of correct current values must be carried out with due consideration to this relationship.

Usually the conductor or conductors for horizontal compensation underneath the pot are located along the central axis thereof, but displacement to one or the other side can according to the circumstances be effected depending upon the location of the current supply bus bar along the side of the pot for vertical compensation.

Figure 2:
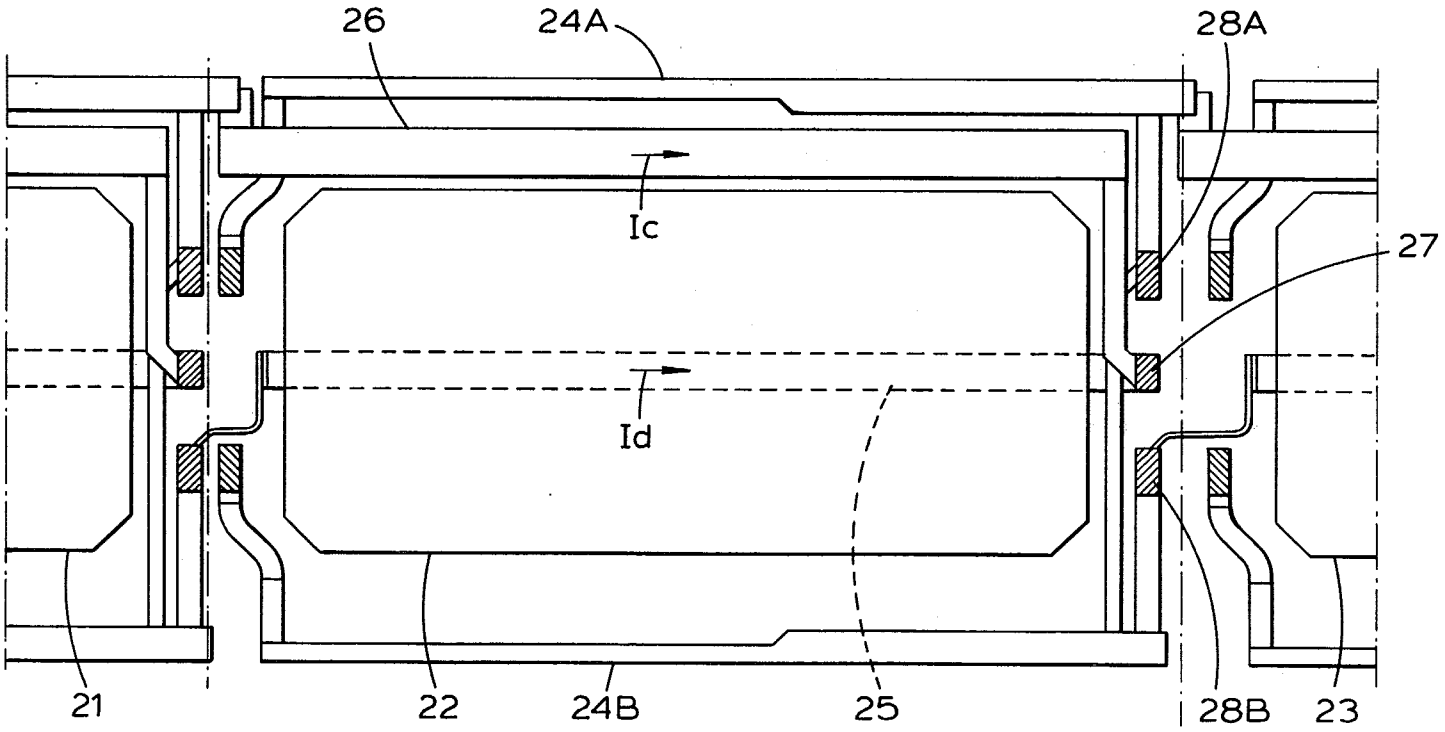
FIGS. 2 and 3 show in plan view and cross-section, respectively, how the current supply underneath a pot can be carried out in practice.
Figure 3:
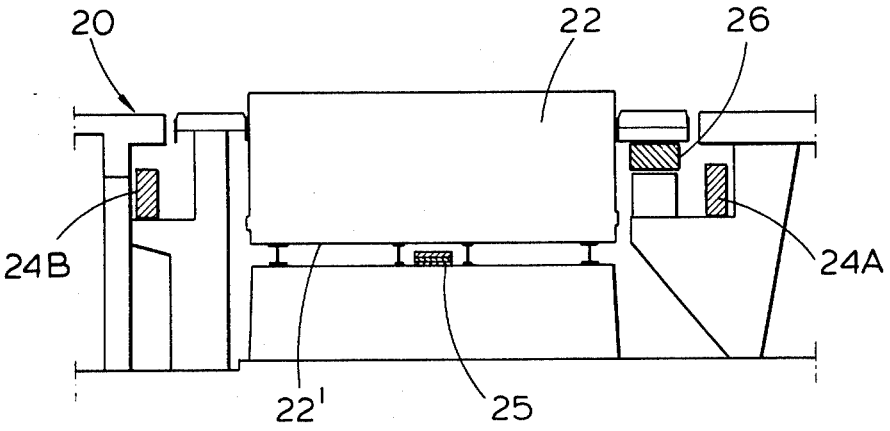

FIGS. 2 and 3 show somewhat simplified a practical example of how the arrangement of bus bars can be in a section of a pot row containing pots 21, 22 and 23 through which the electrolysis current flows in the order mentioned.

Along pot 22 there are arranged regular cathode bus bars 24A and 24B which are stepped up to larger cross-sectional areas towards the minus end of the pot and which through lateral connections supply current to anode riser conductors 28A and 28B for the following pot 23.

At one longitudinal side of pot 22 there is shown a specific bus bar 26 which provide the vertical compensation as explained previously. The compensation current is led to an auxiliary anode riser 27 at the minus end of pot 22 for supplying current to the anode thereof.

Underneath pot 22 there is located an additional bus bar 25 which also carries current to the auxiliary anode riser 27 from the plus end of the pot. As it appears specifically from FIG. 3 this bar or conductor 25 is positioned with its flat side facing and closely adjacent the pot bottom 22'. In spite of the somewhat unfavourable cooling relationships with such an orientation of this conductor cross-section, this is preferred because the desired effect on the magnetic field can then be obtained with a smaller current proportion in this conductor. It is, however, obvious that the conductor 25 can be arranged and oriented in other ways underneath the pot, including subdivision into several smaller bus bars etc.

Finally, it appears from FIG. 3 that both the regular cathode bus bars 24A and 24B as well as the compensation bus bar 26 and of course the additional conductor 25 underneath pot 22, are all located at a level below the floor 20 in the pot room.

I claim:

1. In a plant for the melt-electrolytic production of aluminum, said plant being of the type including a plurality of pots arranged in at least one longitudinal row, means for serially passing current through said row of pots from one end of said row to the opposite end thereof, such that each of said pots has a positive upstream end and a negative downstream end, taken in the longitudinal direction of said row, said passing means including, for each said pot, anode means for receiving said current from the adjacent upstream pot and for introducing said current into the said positive upstream end of said each pot, and cathode means for collecting said current from said each pot and supplying said current to the said anode means of the adjacent downstream pot, the improvement comprising:

means for compensating for detrimental magnetic horizontal fields occurring at the said positive upstream end of each said pot, said compensating means comprising, for each said pot, at least one conductor means for bypassing a minor portion of said current from said positive upstream end of said each pot to said negative downstream end thereof, and for supplying said minor portion of said current to said negative downstream end, said minor portion comprising a maximum of 20% of the total anode current supply to said each pot, said conductor means extending longitudinally beneath said each pot, centrally thereof, and closely adjacent the bottom thereof.

2. The improvement claimed in claim 1, wherein, for said pots between and inwardly of said opposite longitudinal ends of said row, said minor portion comprises a maximum of 10% of the total anode current supply.

3. The improvement claimed in claims 1 or 2, wherein said conductor means for each said pot comprises at least one longitudinally extending flat bar having a flat side facing the respective said pot bottom.

4. The improvement claimed in claim 1, wherein said plant includes at least two laterally adjacent, longitudinally extending said rows of pots, and further comprising, for each said pot of each said row, means for compensating for vertical magnetic influence from an adjacent said row, said vertical compensating means comprising lateral conductor means, extending along a side of said each pot facing said adjacent row, for bypassing a further minor portion of said current from said positive upstream end of said each pot to said negative downstream end thereof, and for supplying said further minor portion of said current to said negative downstream end.

* * * * *